US009095502B2

(12) United States Patent
Williams et al.

(10) Patent No.: US 9,095,502 B2
(45) Date of Patent: Aug. 4, 2015

(54) LOW PROFILE G-J FEEDING TUBE

(75) Inventors: Derek M. Williams, Cuyahoga Falls, OH (US); Grant W. Phillips, Richfield, OH (US)

(73) Assignee: APPLIED MEDICAL TECHNOLOGY, INC., Brecksville, OH (US)

( * ) Notice: Subject to any disclaimer, the term of this patent is extended or adjusted under 35 U.S.C. 154(b) by 210 days.

(21) Appl. No.: 13/024,003

(22) Filed: Feb. 9, 2011

(65) Prior Publication Data

US 2012/0203171 A1 Aug. 9, 2012

(51) Int. Cl.
*A61J 15/00* (2006.01)

(52) U.S. Cl.
CPC ..... *A61J 15/0015* (2013.01); *A61J 15/0042* (2013.01); *A61J 15/0065* (2013.01); *A61J 15/0069* (2013.01); *A61J 15/0073* (2013.01); *A61J 15/0007* (2013.01)

(58) Field of Classification Search
CPC ..... A61M 25/0026; A61M 2025/0031; A61M 25/0032
USPC ..... 604/533, 509, 910, 175, 174, 43, 604/103.03, 104, 106
See application file for complete search history.

(56) References Cited

U.S. PATENT DOCUMENTS

| | | | | |
|---|---|---|---|---|
| 4,393,873 | A * | 7/1983 | Nawash et al. | 604/151 |
| 4,986,810 | A | 1/1991 | Semrad | |
| 5,057,091 | A | 10/1991 | Andersen | |
| 5,152,756 | A | 10/1992 | Quinn et al. | |
| 5,405,341 | A * | 4/1995 | Martin | 604/284 |
| 5,486,159 | A | 1/1996 | Mahurkar | |
| 5,527,280 | A | 6/1996 | Goelz | |
| 5,823,805 | A * | 10/1998 | Weihing et al. | 439/108 |
| 6,352,544 | B1 * | 3/2002 | Spitz | 606/159 |
| 6,547,761 | B2 * | 4/2003 | Liu | 604/104 |
| 6,896,665 | B2 | 5/2005 | Picha et al. | |
| 6,997,909 | B2 | 2/2006 | Goldberg | |
| 6,997,931 | B2 * | 2/2006 | Sauer et al. | 606/139 |

(Continued)

FOREIGN PATENT DOCUMENTS

| | | | |
|---|---|---|---|
| DE | 3731590 | C1 | 7/1988 |
| EP | 0182539 | A1 | 5/1986 |

(Continued)

OTHER PUBLICATIONS

European Search Report dated Jun. 24, 2013.

*Primary Examiner* — Nicholas Lucchesi
*Assistant Examiner* — Melissa A Snyder
(74) *Attorney, Agent, or Firm* — Pearne & Gordon LLP

(57) ABSTRACT

A gastro-jejunal (G-J) feeding device includes a gastro-jejunal body and an integral feeding tube. The gastro-jejunal body includes a gastric port, a jejunal port and a balloon port. The integral feeding tube includes a proximal end and a distal end and further includes a gastric lumen, a jejunal lumen and a balloon lumen. The proximal end is configured to be located outside of a patient's body. The distal end is configured to be inserted into a patient's body and has a deformable portion with a default shape having a width larger than a diameter of a tubular portion. A capsule is configured to be placed on the distal end so as to enclose and deform the deformable portion. The capsule is configured to dissolve upon contact with bodily fluid. The deformable portion is configured to return to the default shape upon dissolution of the capsule.

24 Claims, 4 Drawing Sheets

(56) References Cited

U.S. PATENT DOCUMENTS

| | | | |
|---|---|---|---|
| 7,048,722 | B2 | 5/2006 | Quinn |
| 7,220,253 | B2 | 5/2007 | Kantsevoy et al. |
| 7,419,479 | B2 | 9/2008 | Quinn |
| 7,582,072 | B2 | 9/2009 | McMichael |
| 2003/0097099 | A1 | 5/2003 | Quinn |
| 2003/0225369 | A1 | 12/2003 | McMichael et al. |
| 2003/0225392 | A1 | 12/2003 | McMichael et al. |
| 2003/0225393 | A1 | 12/2003 | McMichael et al. |
| 2005/0124932 | A1 | 6/2005 | Foster et al. |
| 2005/0124935 | A1 | 6/2005 | McMichael |
| 2006/0052752 | A1* | 3/2006 | McMichael ..... 604/175 |
| 2010/0030138 | A1 | 2/2010 | Kantsevoy et al. |

FOREIGN PATENT DOCUMENTS

| | | | |
|---|---|---|---|
| EP | 0238952 | A2 | 9/1987 |
| WO | 2007123630 | A1 | 11/2007 |

* cited by examiner

LOW PROFILE G-J FEEDING TUBE

TECHNICAL FIELD

The present invention relates generally to feeding tubes, and more particularly, to low-profile, gastro-jejunal feeding tubes.

BACKGROUND

Feeding devices are used to provide food or medication to patients who cannot ingest these substances in a normal manner. While the feeding device needs to be equipped with a variety of features, such as a plurality of passages for providing a number of different substances, the multiple features can increase the size or volume of the feeding tube and may cause discomfort to the patient wearing it. Thus, there is a need for a feeding device that is small in size and in which a plurality of features are integrated into a single device.

SUMMARY

In one example aspect, a gastro-jejunal (G-J) feeding device includes a gastro-jejunal body and an integral feeding tube. The gastro-jejunal body includes a top portion, a bottom portion and a balloon port. The bottom portion is configured to abut a patient's skin. The top portion of the G-J body is provided with a gastric port leading to a gastric channel and a jejunal port leading to a jejunal channel. The integral feeding tube includes a proximal end and a distal end. The proximal end is operatively connected to the bottom portion of the gastro-jejunal body. The integral feeding tube further includes a gastric lumen, a jejunal lumen and a balloon lumen. The gastric lumen is configured to be in fluid communication with the gastric channel and extends from the proximal end to an intermediate portion of the integral feeding tube. The jejunal lumen is configured to be in fluid communication with the jejunal channel and extends from the proximal end to the distal end. The balloon lumen is configured to be in fluid communication with the balloon port.

In another example aspect, a feeding tube for insertion into a stoma includes a tubular portion, a proximal end, a distal end and a capsule. The proximal end is configured to be located outside of a patient's body. The distal end is configured to be inserted into a patient's body and has a deformable portion with a default shape having a width larger than a diameter of the tubular portion. The capsule is configured to be placed on the distal end so as to enclose and deform the deformable portion. The capsule is configured to dissolve upon contact with bodily fluid. The deformable portion is configured to return to the default shape upon dissolution of the capsule.

BRIEF DESCRIPTION OF THE DRAWINGS

These and other aspects are better understood when the following detailed description is read with reference to the accompanying drawings, in which.

DETAILED DESCRIPTION

Figure 1:
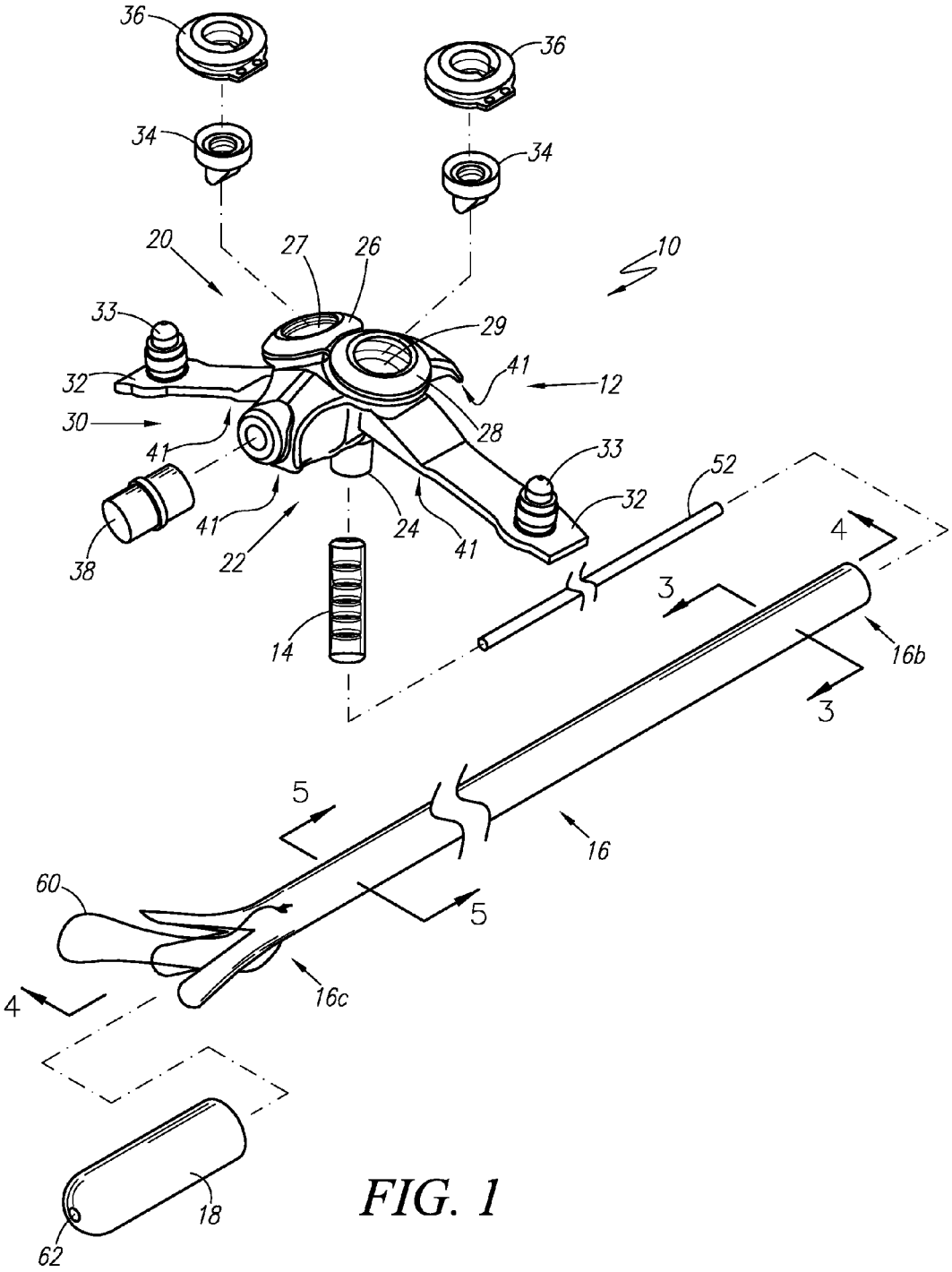
FIG. 1 is an exploded view of an example embodiment of a gastro-jejunal (G-J) device.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example embodiment of a low-profile, gastro-jejunal (G-J) feeding device 10 is shown. The G-J feeding device 10 provides passageways to the stomach and the jejunum and allows for food or medicine to be supplied in fluid form for ingestion. The device 10 may also allow for removal of matter from the stomach or the jejunum by way of suction where, for example, the function of the digestive organ is impaired and the patient experiences gastric reflux, vomiting or the like.

As shown in FIG. 1, the G-J feeding device 10 may include primarily a G-J body 12, a balloon 14, a feeding tube 16 and a capsule 18. The G-J body 12 may be shaped to have a low profile such that the G-J body 12 forms only a minor projection on the patient's skin. Also, the G-J body 12 may be formed of a soft, flexible material such as silicone and may include a variety of features that are integral with the G-J body 12. The G-J body 12 provides a plurality of ports in which external tubes can be inserted in order to supply fluids from external sources such as containers (not shown) to the G-J body 12 and thus the feeding tube 16.

As shown in FIG. 1, the present embodiment of the G-J body 12 includes a top portion 20 that is configured to face away from the patient's skin and a bottom portion 22 that is configured to abut the patient's skin. The bottom portion 22 includes an outlet 24 that is joined with the feeding tube 16 and may be at least partially inserted into the patient's skin. The G-J body 12 also includes a gastric port 26, a jejunal port 28, and a balloon port 30 which are configured to be in communication with the stomach, the jejunum and the balloon respectively. The G-J body 12 may be configured with various types of notations to distinguish among the ports. While the ports 26, 28 may be provided on a variety of areas on the G-J body 12, the ports 26, 28 are provided on the top portion 20 in this embodiment for ease of access. Thus, once the G-J body 12 is placed on the patient's skin, the gastric port 26 and the jejunal port 28 are oriented away from the patient's skin while the balloon port 30 is oriented laterally about the G-J body 12. The gastric port 26 and jejunal port 28 provide channels that converge at the outlet 24 of the bottom portion 22. The G-J body 12 may also include flaps 32 with plugs 33 for closing the ports 26, 28 when the ports 26, 28 are not in use. In this embodiment, the flaps 32 extend laterally and are configured to be integral parts of the G-J body 12. Moreover, while the flaps 32 are provided only for the gastric port 26 and the jejunal port 28 in this embodiment, a flap may also be provided for the balloon port 30. Moreover, as shown in FIG.

1, the present embodiment of the G-J body 12 is substantially symmetrical in shape and the plane of symmetry passes between the gastric port 26 and the jejunal port 28 through a center of the G-J body 12. Thus, the ports 26, 28 and the flaps 32 substantially mirror one another about the plane of symmetry. Furthermore, in this embodiment, the axis through the gastric port 26 and the axis through the jejunal port 28 are oriented so as to intersect near the outlet 24. Such a configuration provides a short path for the fluids to travel from the ports 26, 28 to the outlet 24 while at the same time reducing a volume of the G-J body 12. For example, a gastric channel 27 originating from the gastric port 26 and a jejunal channel 29 originating from the jejunal port 28 may be substantially straight from the ports 26, 28 to the outlet 24 such that fluids travel the shortest distance therebetween. The G-J body 12 may also be configured with a balloon channel (not shown) originating from the balloon port 30 and routed to the outlet 24.

The outlet 24 of the G-J body 12 includes three channels originating from the gastric port 26, the jejunal port 28 and the balloon port 30. The outlet 24 of the G-J body 12 can be joined with the feeding tube 16 through various means known in the art such as gluing or insert molding.

The ports 26, 28 and 30 can be provided with a valve mechanism that controls transmission of fluid from an external source when external tubes (not shown) are inserted into the ports 26, 28 and 30 while preventing backflow of the fluid out of the ports 26, 28 and 30 when the ports 26, 28 and 30 are not in use. For example, each of the gastric and jejunal ports 26, 28 may include a duckbill valve 34 for controlling flow and an interlock 36 for securing an inserted external tube. The balloon port 30 may include a balloon fill valve 38 as shown in FIG. 1. The G-J body 12 may be configured so that, other than the valves and the interlocks, its features are integrally formed on the G-J body, for example, by molding.

Near the bottom portion 22, the G-J body 12 may include stabilizing features 41 that are configured to contact with the patient's skin. The stabilizing features 41 may be feet-like supporting the G-J body 12 and may also reduce the rocking of the G-J body 12 after the G-J body 12 and the feeding accessories are attached to the patient's body. This can reduce or prevent stoma irritation and potential erosion into the stoma site.

Figure 3:
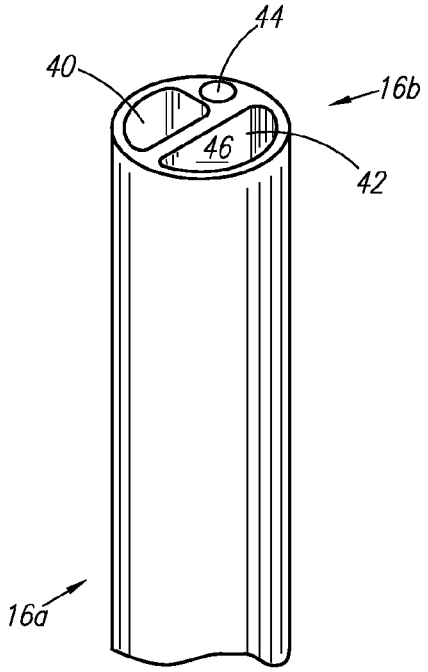
FIG. 3 is a cross-sectional, close-up view of the feeding tube in an isolated state cut in a radial direction near the proximal end.
Figure 4:
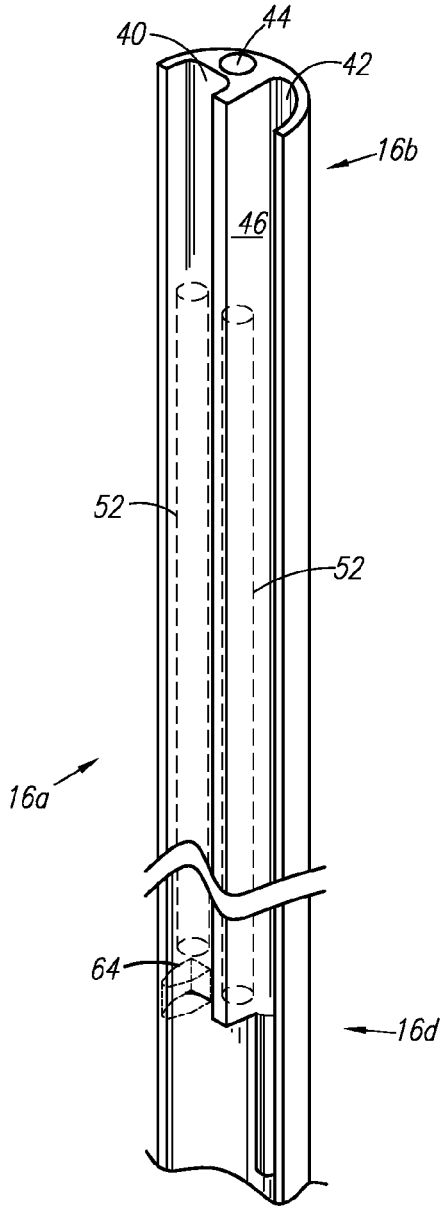
FIG. 4 is a cross-sectional, close-up view of the feeding tube in an isolated state cut in an axial direction.
Figure 5:
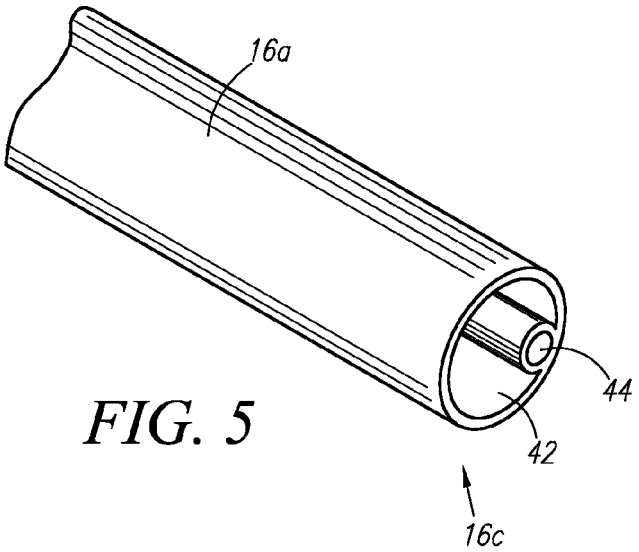
FIG. 5 is a cross-sectional, close-up view of the feeding tube in an isolated state cut in a radial direction near the distal end.

As shown in FIGS. 3-5, the feeding tube 16 includes a tubular portion 16*a*, a proximal end 16*b* and a distal end 16*c*. The feeding tube 16 is made of durable and flexible material resistant to various types of repeated bending, such as silicone, allowing the feeding tube 16 to assume various positions inside the patient's stomach and jejunum. As fluids are supplied to the stomach and the jejunum, the distal end 16*c* is located downstream relative to the proximal end 16*b*. On a portion of the feeding tube 16 beginning at the proximal end 16*b* and extending to an intermediate portion 16*d* thereof, the feeding tube 16 includes a gastric lumen 40, a jejunal lumen 42 and a balloon lumen 44 which are in fluid communication from the channels originating from the gastric port 26, the jejunal port 28 and the balloon port 30 once the outlet 24 is joined with the feeding tube 16. The feeding tube 16 may be formed such that the gastric lumen 40, the jejunal lumen 42 and the balloon lumen 44 are provided integrally on the feeding tube 16. While the feeding tube 16 may be embodied in a variety of French sizes, the feeding tube 16 has a 14 French size in this embodiment.

As shown as a cross-section in FIG. 4, the feeding tube 16 includes a separating wall 46 that divides a passageway of the feeding tube 16 and extends from the proximal end 16*b* to the intermediate portion 16*d* of feeding tube 16 thereby defining the gastric lumen 40 and the jejunal lumen 42. The separating wall 46 may divide the cross-sectional area of the passageway of the feeding tube 16 substantially in half and the balloon lumen 44 may be part of one of the halved cross-sectional areas. Such a configuration of the lumens 40, 42 and 44 may be formed using an extrusion process.

The gastric lumen 40 is closed off at the intermediate portion 16*d* of the feeding tube 16 so that the gastric lumen 40 is not in fluid communication with the jejunal lumen 42. This may be done by using an adhesive 64 to backfill the end of the gastric lumen 40 at the intermediate portion 16*d*, for example, as shown in FIG. 4. Thus, the gastric lumen 40 extends from the proximal end 16*b* to the intermediate portion 16*d* of the feeding tube 16. The jejunal lumen 42 extends from the proximal end 16*b* to the distal end 16*c* and its cross-sectional area is larger between the intermediate portion 16*d* and the distal end 16*c* than between the proximal end 16*b* and the intermediate portion 16*d*. The cross-sectional area of the jejunal lumen 42 between the intermediate portion 16*d* and the distal end 16*c* is thus larger than the sum of the cross-sectional area of the gastric lumen 40 and the cross-sectional area of the jejunal lumen 42 between the proximal end 16*b* and the intermediate portion 16*d*.

Figure 2:
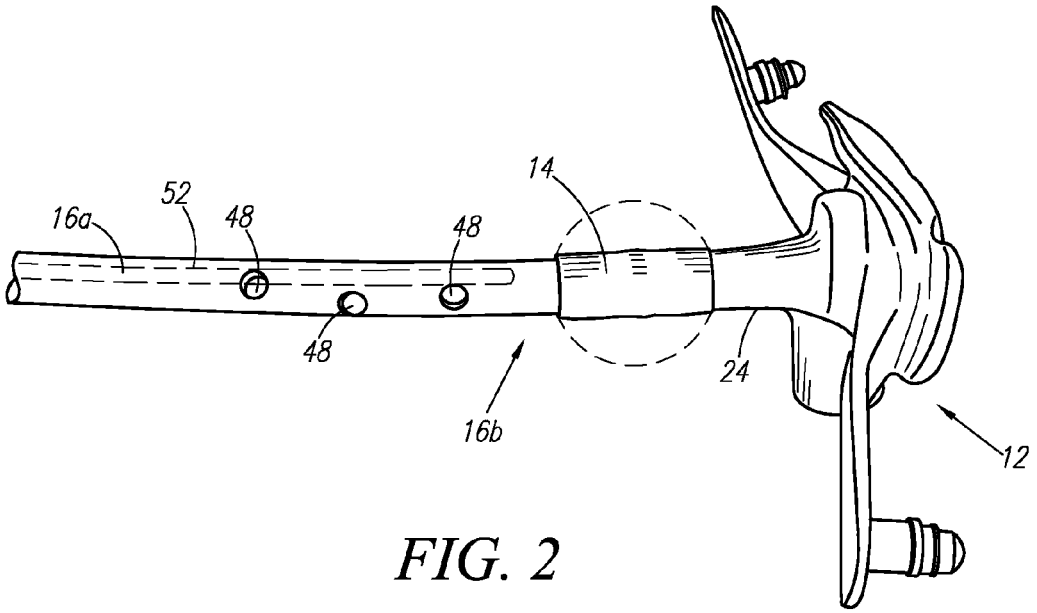
FIG. 2 is a close-up view of the G-J device near a proximal end of a feeding tube.
Figure 6:
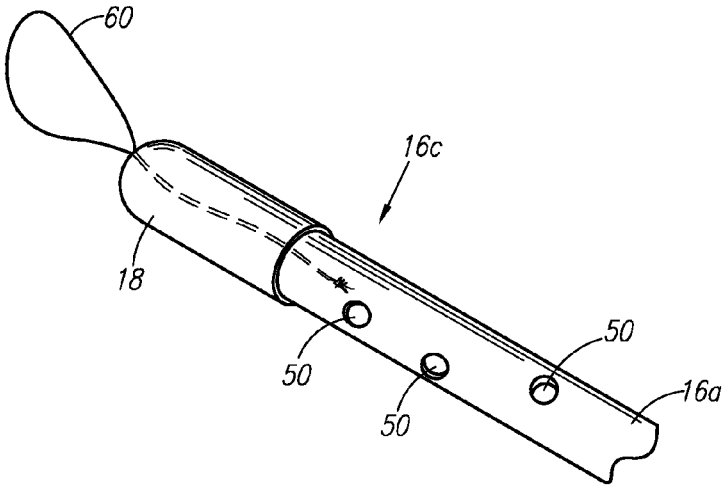
FIG. 6 is a close-up view of the G-J device with a capsule placed on the distal end of the feeding tube.

As shown in FIGS. 2 and 6, the feeding tube 16 is configured with one or more gastric holes 48 that may be formed on the outer wall of a downstream part of the gastric lumen 40 and one or more jejunal holes 50 along the outer wall located exteriorly of a downstream portion of the jejunal lumen 42. As a result, transmission of fluid in and out of the feeding tube 16 is possible through the gastric holes 48 and the jejunal holes 50. Specifically, the feeding tube 16 and the separating wall 46 will be configured to be of such length that the gastric holes 48 and the jejunal hole 50 are located in the stomach and the jejunum respectively and that the gastric lumen 40 is in fluid communication with the stomach while the jejunal lumen 42 is in fluid communication with the jejunum.

In the present embodiment, the balloon 14 is an expandable component that may have a cylindrical shape in its original state and may be placed over the feeding tube 16. The longitudinal ends of the balloon 14 are secured to the exterior of the feeding tube 16 near the proximal end 16*b* by gluing, for example, such that an enclosed space is formed in between the longitudinal ends. The outer wall of the feeding tube 16 to the exterior of the balloon lumen 44 is provided with one or more balloon holes thereby establishing fluid communication between the balloon lumen 44 and the balloon 14. The balloon lumen 44 may be closed off downstream of the balloon hole leading to the enclosed space of the balloon 14. As a result, the balloon 14 can be inflated, as shown in phantom in FIG. 2, by supplying an external fluid, such as air or water, into the balloon port 30.

Additionally, the G-J feeding device 10 may include a stiffening element, such as a wire 52 (FIG. 1), that is inserted either into the balloon lumen 44 or downstream into the gastric lumen 44 and extends partially along the length of the gastric lumen 40. The stiffening element 52, which is shown in phantom in FIG. 4, while malleable, is intended to make a part of the tubular portion less prone to bending and may be made of materials providing flexibility and rigidity such as metal. The stiffening element 52 may extend from near the intermediate portion 16*d* toward the distal end 16*c*, for example, between a portion of the feeding tube 16 downstream of the balloon 14 and the intermediate portion 16*d*. The stiffening element 52 allows for straighter entry into the small intestine and reduces the likelihood of the feeding tube 16 backing out of the patient's body. The stiffening element 52 may be used to close off the balloon lumen 14 downstream of the balloon hole.

Figure 7:
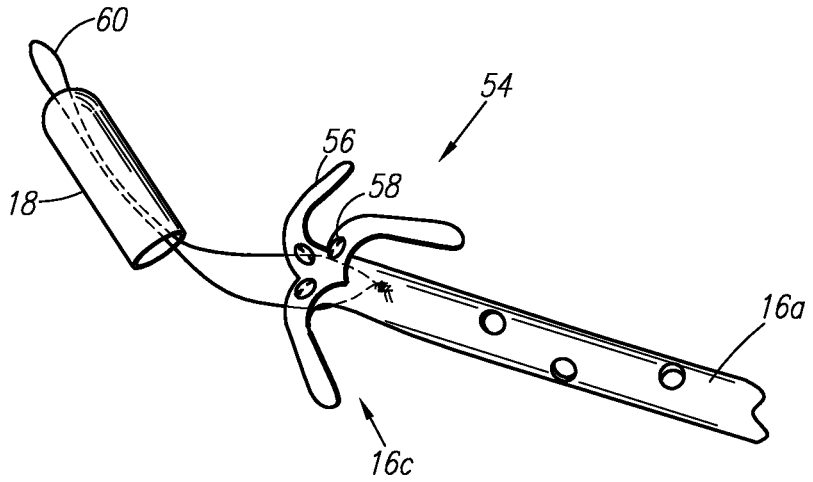
FIG. 7 is a close-up view of the G-J device with a capsule removed from the distal end of the feeding tube with a first embodiment of a deformable portion.
Figure 8:
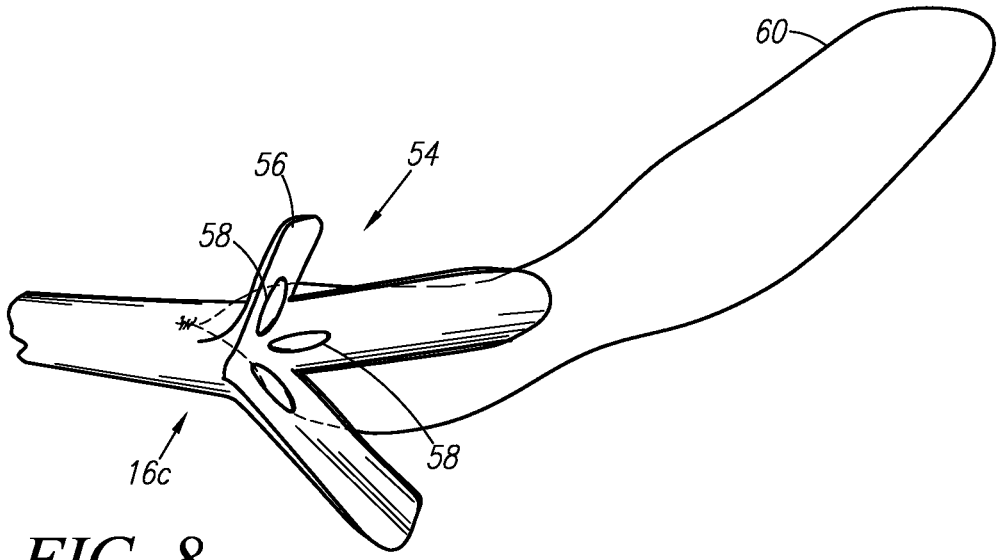
FIG. 8 is a close-up view of the distal end of the feeding tube with a second embodiment of the deformable portion in a default shape.

As shown in FIGS. 7-8, the distal end 16*c* is open and includes a deformable portion 54 that has a default shape dimensioned to be wider than the diameter of the tubular portion 16*a*. The deformable portion 54 can be deformed out of its default shape and may be one or more arm 56 that extends away from the tubular portion 16*a* in an outwardly flared orientation in the default shape. The arm 56 may be integrally formed with the tubular portion 16*a*, or bonded in some manner to the distal end 16*c* of the feeding tube 16. The distal end 16*c* may include a bead 58 formed at an interface of the tubular portion 16*a* and the arm 56 on an interior surface of the feeding tube 16 so as to impart on the arm 56 a flared orientation and biases the arm 56 toward such a position. As such, due to the flexibility of the feeding tube 16, the arm 56 can be deformed to assume a different position and return to a default position. The bead 58 may be formed by applying silicone on the interior surface of the feeding tube 16. The deformable portion 54 may be embodied in a number of ways. For example, the arms 56 may flare outward (FIG. 8) or may be oriented backward toward the proximal end 16*b* in an umbrella-like configuration (FIG. 7). Instead of using beads 58, the umbrella-like configuration may be obtained by attaching a separate piece to the distal end 16*c*.

The design with the open distal end 16*c* allows the device 10 to be guidewire-compatible in both the deformed state and a released, default shape. In particular, after a guidewire (not shown) is inserted into the stomach and the jejunum, it is possible to push the feeding tube 16 into the patient's body with the feeding tube 16 sliding past the guidewire and the guidewire extending through the jejunal lumen 42.

A loop of suture 60 may be connected to the distal end 16*c* such that the distal end 16*c* may be pulled by the loop 60 using an instrument such as an endoscope. However, the feeding tube 16 may also be inserted into a patient's body by pushing the feeding tube 16 into a stoma without using an instrument.

Moreover, as shown in FIG. 6, the capsule 18 may be placed on the distal end 16*c* of the feeding tube 16 for reducing the dimension of the distal end 16*c* and facilitating travel of the distal end 16*c* within the patient's body, especially the intestines. The capsule 18 may be made of material that dissolves upon contact with bodily fluids, such as vegetable cellulose (HPMC). The capsule 18 may provide an aperture 62 to allow the loop of suture 60 to extend past the capsule 18 and allow the loop 60 to be pulled by an instrument. In case a guidewire is used to insert the feeding tube 16, the guidewire is passed through the aperture 62 on the capsule 18 and the feeding tube 16 is pushed and inserted past the guidewire.

Prior to insertion of the distal end 16*c* into a patient's body, the capsule 18 is placed on the distal end 16*c* and the arms 56 become deformed to be accommodated into the capsule 18. The distal end 16*c* is thereafter inserted into a patient's body until the distal end 16*c* is located in the patient's jejunum. The capsule 18 is allowed to dissolve after a predetermined amount of time and the arms 56 are allowed to return to a flared orientation. The arms 56 in the flared orientation restrict the movement of the distal end 16*c* within the jejunum and prevent distal end 16*c* from being repelled out of the jejunum.

It will be apparent to those skilled in the art that various modifications and variations can be made without departing from the spirit and scope of the claimed invention.

What is claimed is:

1. A gastro-jejunal (G-J) feeding device, including:

a gastro-jejunal body including a top portion, a bottom portion and a balloon port, the bottom portion configured to abut a patient's skin, the top portion of the G-J body provided with a gastric port leading to a gastric channel and a jejunal port leading to a jejunal channel; and a multi-lumen, unitary structure feeding tube including a proximal end and a distal end, with a length extending in a longitudinal direction between the proximal and distal ends and a transverse direction being in a plane that is perpendicular to the length, the proximal end operatively connected to the bottom portion of the gastro-jejunal body, the multi-lumen, unitary structure feeding tube including:

a gastric lumen configured to be in fluid communication with the gastric channel and extending from the proximal end to an intermediate portion of the feeding tube;

a jejunal lumen configured to be in fluid communication with the jejunal channel and extending from the proximal end to the distal end; and a balloon lumen configured to be in fluid communication with the balloon port and extending from the proximal end to an intermediate portion of the feeding tube;

wherein the gastric lumen, jejunal lumen and balloon lumen share a common separating wall inside the feeding tube and a transverse cross-sectional area of the jejunal lumen is larger between the intermediate portion and the distal end than between the intermediate portion and the proximal end.

2. The G-J device of claim 1, wherein the transverse cross-sectional area of the jejunal lumen between the intermediate portion and the distal end is larger than a sum of a transverse cross-sectional area of the gastric lumen and the transverse cross-sectional area of the jejunal lumen between the proximal end and the intermediate portion.

3. The G-J device of claim 1, the feeding tube further including at least one gastric hole such that the gastric lumen is in fluid communication with an exterior of the feeding tube, and the feeding tube further including at least one jejunal hole such that the jejunal lumen is in fluid communication with the exterior of the feeding tube.

4. The G-J device of claim 1, further including a balloon secured over the feeding tube, the balloon in fluid communication with the balloon lumen and configured to inflate so as to keep the feeding tube substantially under a patient's skin.

5. The G-J device of claim 1, wherein the G-J body is substantially symmetrically shaped about a plane of symmetry extending through the top portion and the bottom portion, and the gastric port and the jejunal port are oriented at a non-perpendicular angle about the plane of symmetry so as to substantially mirror one another.

6. The G-J device of claim 5, wherein the gastric port and the jejunal port are angled so that the gastric channel and the jejunal channel converge near the bottom portion.

7. The G-J device of claim 1, wherein the G-J body includes integral flaps for closing the gastric port and the jejunal port.

8. The G-J device of claim 1, wherein the gastric port, the jejunal port and the balloon port each include a valve.

9. The G-J device of claim 1, wherein the feeding tube has a 14-French size.

10. The G-J device of claim 1, further including a stiffening element that is located either inside the balloon lumen or the gastric lumen and extends from the intermediate portion toward the proximal end of the feeding tube.

11. The G-J device of claim 10, further including a balloon secured over the feeding tube, the stiffening element extending between the intermediate portion and the balloon.

12. The G-J device of claim 1, wherein the distal end of the feeding tube has a deformable portion coupled to the jejunal lumen at the distal end thereof, the deformable portion having a default shape with a width that is wider than a diameter of the feeding tube wherein the deformable portion facilitates retaining the jejunal lumen in the jejunum after it has been inserted into the jejunum.

13. The G-J device of claim 12, wherein the default shape comprises an arm with an outwardly flared orientation, wherein the arm is integrally coupled to a tubular portion of the jejunal lumen at a proximal end of the arm and the arm has a free end at a distal end of the arm that extends away from the tubular portion.

14. The G-J device of claim 13, further comprising a bead that is positioned at an interface of the arm and the feeding tube and is configured to impart on the arm the outwardly flared orientation; and further comprising a loop of suture coupled to the feeding tube near the distal end thereof, with the distal end of the feeding tube being configured to be inserted into a patient's body by pulling the loop of suture.

15. The G-J device of claim 1, wherein the gastric port and the jejunal port are each oriented at a non-parallel angle relative to the bottom portion.

16. The G-J device of claim 15, wherein the gastric port is oriented at an angle that is opposite the angle of orientation of the jejunal port.

17. A gastro-jejunal (G-J) feeding device, including:

a gastro-jejunal body including an upper surface, a bottom surface, and a side portion, with the bottom surface configured to abut a patient's skin;

a gastric port coupled to the upper surface of the G-J body;

a jejunal port coupled to the upper surface of the G-J body;

a balloon port coupled to a side portion of the body; and a feeding tube coupled to the bottom surface of the G-J body and in fluid communication with the gastric port, the jejunal port, and the balloon port, said feeding tube having a length and a configuration such that said tube extends into both a patient's stomach and jejunum, wherein the gastric port lies in a plane that is positioned at a first angle relative to the bottom surface of the G-J body, with the gastric port plane being non-parallel to the bottom surface, the jejunal port lies in a plane that is positioned at a second angle relative to the bottom surface of the G-J body, with the jejunal port plane being non-parallel to the bottom surface, and wherein the distal end of the feeding tube has a deformable portion coupled to the jejunal lumen at the distal end thereof that facilitates retaining the jejunal lumen in the jejunum after it has been inserted into the jejunum, the deformable portion having a default shape with a width that is wider than a diameter of the feeding tube, the default shape comprising an arm with an outwardly flared orientation, wherein the arm is integrally coupled to a tubular portion of the jejunal lumen at a proximal end of the arm and the arm has a free end at a distal end of the arm that extends away from the tubular portion, and wherein a bead is positioned at an interface of the arm and the feeding tube and is configured to impart on the arm the outwardly flared orientation.

18. The G-J device of claim 1, wherein the shared separating wall is coupled to a shared outer wall to form the unitary structure.

19. The G-J device of claim 1, wherein the cross-sectional area, as measured in a plane that is perpendicular to the length, of the jejunal lumen is always greater than the cross-sectional area, as measured in a plane that is perpendicular to the length, of the gastric lumen.

20. A gastro-jejunal (G-J) feeding device comprising:

a gastro-jejunal body including a top surface, a bottom surface and a balloon port; the bottom surface being at least in part planar and configured to abut a patient's skin in substantially parallel relation thereto, the top surface being multi-planar and provided with a gastric port leading to a gastric channel and a jejunal port leading to a jejunal channel, and an outlet coupled to the bottom surface; and a feeding tube coupled to the bottom surface of the G-J body and in fluid communication with the gastric port and the jejunal port, said feeding tube having a length and a configuration such that said tube extends into both a patient's stomach and jejunum, wherein the gastro-jejunal body is substantially symmetrical in shape and a plane of symmetry passes between the gastric port and the jejunal port through a center of the G-J body such that the gastric port and jejunal port substantially mirror one another about the plane of symmetry; and wherein a top surface of the gastric port forms a first plane and a top surface of the jejunal port forms a second plane that is different from the first plane, and the first and second planes are not parallel to the bottom surface of the G-J body, and wherein the distal end of the feeding tube has a deformable portion coupled to the jejunal lumen at the distal end thereof that facilitates retaining the jejunal lumen in the jejunum after it has been inserted into the jejunum, the deformable portion having a default shape with a width that is wider than a diameter of the feeding tube, the default shape comprising an arm with an outwardly flared orientation, wherein the arm is integrally coupled to a tubular portion of the jejunal lumen at a proximal end of the arm and the arm has a free end at a distal end of the arm that extends away from the tubular portion, and wherein a loop of suture is coupled to the feeding tube near the distal end thereof, with the distal end of the feeding tube being configured to be inserted into a patient's body by pulling the loop of suture.

21. The gastro-jejunal (G-J) feeding device of claim 20, wherein the gastric channel has a longitudinal axis and the jejunal channel has a longitudinal axis, and the longitudinal axis through the gastric channel and the longitudinal axis through the jejunal channel are oriented so as to intersect near the outlet of the G-J body.

22. The gastro-jejunal (G-J) feeding device of claim 20, wherein the balloon port is positioned on a side surface of the gastro-jejunal body, with the balloon port having a longitudinal axis that is parallel to the bottom surface.

23. The G-J feeding device of claim 17, wherein the bead is formed on an interior surface of the feeding tube.

24. The gastro-jejunal (G-J) feeding device of claim 20, further comprising a capsule coupled to and enclosing the deformable portion at the distal end of the feeding tube, wherein the capsule dissolves upon contact with bodily fluids, allowing the deformable portion to return to its default shape, and wherein the capsule comprises an aperture to allow the loop of suture to pass through the aperture and be pulled by an instrument.

* * * * *